United States Patent [19]

Mastropole

[11] 4,102,320

[45] Jul. 25, 1978

[54] FIREPLACE HEAT EXCHANGER

[76] Inventor: Anthony Mastropole, East Meredith, N.Y. 13757

[21] Appl. No.: 796,692

[22] Filed: May 13, 1977

[51] Int. Cl.[2] ..... F24B 7/04

[52] U.S. Cl. ..... 126/121

[58] Field of Search ..... 126/121; 237/51

[56] References Cited

U.S. PATENT DOCUMENTS 4,019,492 4/1977 Rush ..... 126/121

FOREIGN PATENT DOCUMENTS 387,624 6/1908 France ..... 126/121

*Primary Examiner*—Gerald A. Michalsky

*Attorney, Agent, or Firm*—John Maier

[57] ABSTRACT

A fireplace heat exchanger surrounding the fire with two upper cross members to the rear of the fire extending horizontally back and forth between two U-shaped side sections. Baffles direct the air back and forth through the two cross members between the two U-shaped side sections. The heated air is circulated through the heating system either by natural circulation or by forced draft.

10 Claims, 3 Drawing Figures

FIREPLACE HEAT EXCHANGER

DESCRIPTION OF THE PRIOR ART

Although a fireplace is well-known to be inefficient for heating, due to the high cost of fuels such as oil, gas and electricity, it is increasingly common to rely upon wood and possibly coal as a source of heat. Unfortunately, the fireplaces now existing in homes were built for recreational and ornamental purposes making their capacity for heating limited.

Some fireplaces have been built with a heat exchange device, but unless initially so built, the modification of the existing fireplace would be too expensive to permit such a modification. Numerous versions have been made of a heat exchange device to be placed in the fireplace. Many efforts have been made, one of the more common efforts has been to construct a fireplace grate of tubing, which takes air from the room through the bottom and passes it upward and out into the room through a series of substantially parallel tubes of small diameter. A force draft means has been on occasion combined with such a device. In some cases, various modifications and combinations are used so that the unit may be installed in an ornamental fashion.

Examples of some of the eariler efforts are shown in the following United States Patents:

Kampf et al; 3,938,496
Lassey et al; 3,930,490
Stites; 3,901,212
Abshear; 3,880,141
Englert; 3,635,211
Curson; 3,601,117
Pierce; 1,747,259
Nichols; 1,653,466

As is well-known by people who are frequent users of a fireplace, the grates of a fireplace quickly burn out. A heat exchanger made like a grate is far more expensive than a standard grate and must be replaced on a regular basis. When a grate and heat exchanger combination burns through, there occurs the added problem of permitting the air passing through the tubes to pick up sparks and products of combusion and discharge such objects into the space being heated.

In other cases because of the closeness of the tubes, a loss of draft is created and the fireplace may well smoke.

OBJECTS AND ADVANTAGES OF THE INVENTION

It is an object of this invention to provide a heat exchanger for utilizing the heat of a fireplace to heat the air circulating through the heat exchanger.

It is another object of this invention that the heat exchanger is constructed in such a manner that it will not have an adverse effect upon the draft characteristics of the fireplace.

It is still another object of this invention to provide a heat exchanger for a fireplace which is durable.

It is still another object of this invention to provide a heat exchanger for a fireplace that is easy to install and readily movable.

It is still a further object of this invention to provide a heat exchanger for a fireplace that will substantially cut the heat loss of a fireplace.

It is still a further object of this invention to provide a heat exchanger that is simple in construction and operation.

It is still a further object of this invention to provide a heat exchanger for a fireplace which may be inexpensively custom constructed to fit neatly and attractively within the fireplace opening.

These, together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Referring to the drawings which are for illustrative purposes only.

DESCRIPTION OF A PREFERRED EMBODIMENT

Figure 1:
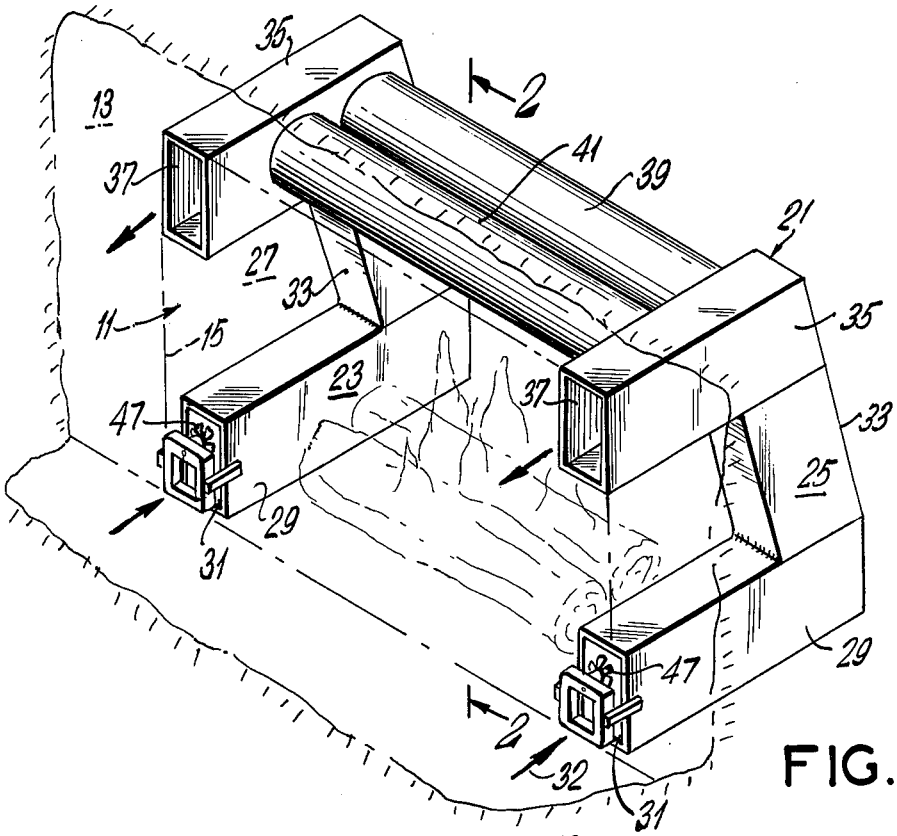
FIG. 1 is a perspective view of the fireplace heat exchanger with a dot-dash outline of the surrounding environment.
Figure 2:
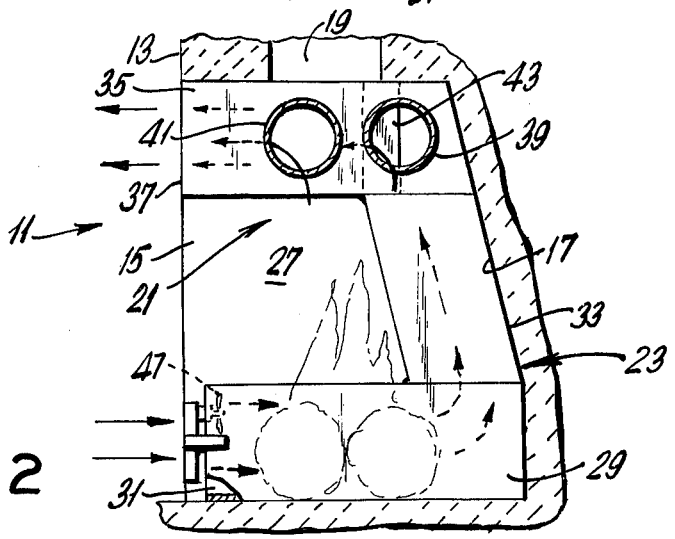
FIG. 2 is a cross-sectioned view of the fireplace heat exchanger taken along lines 2-2 of FIG. 1.
Figure 3:
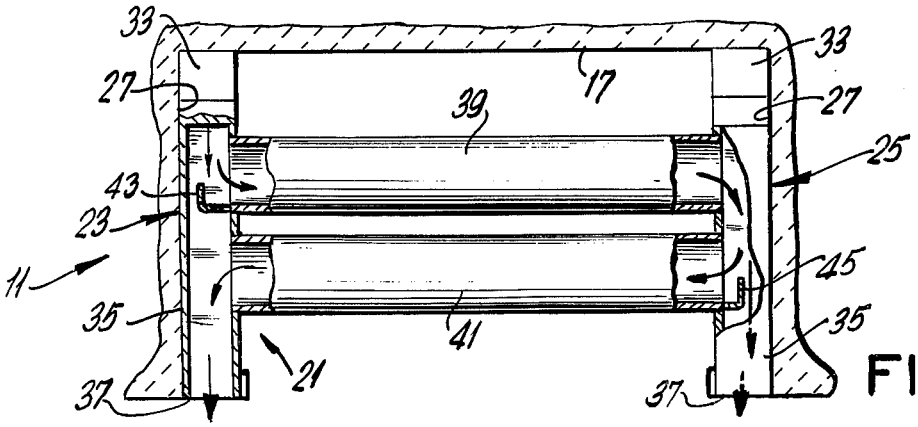
FIG. 3 is a top plan view of the fireplace heat exchanger, partially broken away, in order to better reveal some of the structure.

Referring now to the drawings and more particularly to FIG. 1 there is shown a generally conventional fireplace 11 including a face 13 with an opening 15. A rear wall 17 of the fireplace 11 slopes upwardedly and forwardedly to a flue 19. The heat exchanger 21 of this invention compromises a pair of substantially vertical U-shaped sections 23, 25. Each U-shaped member is turned to that the open portion of the U is at the fireplace opening 15. The left U-shaped side section 23 and the right U-shaped side section 25 are aligned close to and substantially parallel with the sides 27 of the fireplace. For purpose of clarity, the left and right U-shaped side sections 23, 25 are at the left and right sides of one looking at the fireplace as shown in FIG. 1. Although the heat exchanger 21 may be constructed with the U-shaped side sections 23, 25 parallel to one another or in some other configuration, the heat exchanger is best custom built for each fireplace. Where the fireplace walls slope inwardedly and backwardly, so do the left and right U-shaped side sections 23, 25. It is preferred that the left and right U-shaped side sections be built of heavy gaged steel being rectangular in shape. The cross-sectional area of each of the U-shaped side sections should be between ten and twenty square inches with the most preferable design having a cross-sectional area between 16 and 18 square inches. The unit as shown utilizes a rectangular duct with three by six inch dimensions. Also very suitable is a four inch by four inch dimension, the latter being more suitable for a forced draft installation.

Each of the U-shaped side sections 23, 25 includes a lower base duct or lower duct 29 with an opening 31 at the outside of the fireplace. The opening 31 serves as an inlet for the cool air to be heated. When forced draft is desired, a source may be used at the inlet 32. A riser duct 33 is connected to the back end of the lower base duct 29 and is usually inclined forwardedly and upwardedly in accordance with the conventional configuration for the rear wall 17 of the fireplace 11. Where the back wall of the fireplace is generally vertical, then so is the riser duct 33. The exact angle of the riser duct 33 will be in accordance with the slope of the fireplace 11. An upper duct 35 is connected at its rear portion to the upper end of the riser duct 33. The upper duct 35 is located in a generally horizontal position above the lower duct. The outside end 37 of the upper duct 35 is open and serves as a exit for the heated air.

The left U-shaped section 23 and the right U-shaped section 25 are connected at the rear portion of the upper ducts 35 by a rear horizontal duct 39 substantially parallel with the rear wall 17 of the fireplace 11. Adjacent thereto and horizontal with the rear horizontal duct 39 is a forward horizontal duct 41 which is located substantially parallel to the rear horizontal duct 39. Both the rear horizontal duct 39 and the forward horizontal duct 41 preferably have the same duct size, preferably a four-inch diameter circular steel pipe. In the upper duct 35 of the left U-shaped section 23, a baffle 43 is installed to deflect air into the rear horizontal duct 39. Similarly in the upper duct 35 of the right U-shaped section 25 a baffle 45 is installed to deflect air into the forward horizontal duct 41. In this way, air enters the heat exchanger 21 through both the openings 31 in the left U-shaped section 23 and the right U-shaped section 25. The air rises through the riser ducts of the left U-shaped section 23 and the right U-shaped section 25. As soon as the air from the riser duct 33 of the left U-shaped section enters the upper duct 35 of the left U-shaped section 23, a portion of the air is forced by the baffle 43 through the rear horizontal tube 39 over to the upper duct of the right U-shaped section 25. Air in the upper duct 35 of the right U-shaped section 25 is forced across the forward horizontal duct 41 to the upper duct of the left U-shaped section 23. Air is expelled into the room at the open end 37 of the upper ducts 35 of both the left U-shaped section 23 and the right U-shaped section 25.

A forced draft can be achieved by the use of a pair of fans 47. The fans 47 are of equal capacity. The usual range of each fan 47 could be between 40 cfm and 200 cfm. In this way, an equal amount of air through the two U-shaped side sectons 23, 25 is accomplished as compared with a manifold supplying a multiplicity of small tubes. Also, the fans 47 are located at the face 13 of the opening 15 of the fireplace 11 so as not to disturb the fire or pick up products of combustion. Since the fans 47 are located either slightly behind or flush with the fireplace screen, they are not out in the room connected by an unsightly hose.

A thermostatic control (not shown) may be added so as automatically to shut off the fans 47 when the heat of the fire drops below a predetermined level such as 100° F.

The efficiency of a presently existing fireplace may be increased through the use of either natural convection or a forced air source. In this way, the efficiency of the fireplace is increased many fold without a detrimental effect upon the appearance of the fireplace and in an durable and simple manner which does not interfere with the normal draft of the fireplace. The heat exchanger 21 may be used with any suitable fuel in the fireplace be it wood, gas, charcoal or coal or any liquid fuel such as oil or kerosene since the purpose of the heat exchanger 21 is to increase the heat into the room regardless of which source of heat is used in the fireplace to create the heat. However, due to the high cost of other fuels, wood will probably be the most utilized fuel.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as my invention is:

1. A heat exchanger for installation in a fireplace comprising:

a left U-shaped side section and a right U-shaped side section each having a lower duct, a riser duct and an upper duct, the lower duct and the upper duct of each respective U-shaped side section being substantially parallel with one another and both lower ducts and both upper ducts having an outer end and an inner end, each outer end being open, each riser duct being inclined generally upwardedly, and being connected at its upper end to the inner end of its respective upper duct and at its lower end to the inner end of its respective lower duct, said left and right U-shaped sections being spaced apart to permit a source of heat to be placed between the two U-shaped side sections;

a rear horizontal duct connected at one end to the upper duct of the left U-shaped side section adjacent the inner end of the upper duct and at the other end to the upper duct of the right U-shaped side section adjacent to the inner end of the upper duct;

a forward horizontal duct located adjacent the rear horizontal duct toward the open ends of said upper duct and lower duct and being connected at one end to the upper duct of the left U-shaped side section and at the other end to the upper duct of the right U-shaped side section; and baffle means for deflecting air from the left U-shaped side section and the right U-shaped side section into the rear horizontal duct and the forward horizontal duct.

2. A heat exchanger according to claim 1 wherein said left U-shaped side section and said right U-shaped side section each are rectangular in cross-section.

3. A heat exchanger according to claim 2 wherein said rear horizontal duct and said forward horizontal duct are both circular in cross-section.

4. A heat exchanger according to claim 1 wherein said left U-shaped side section and said right U-shaped side section each are square in cross-section.

5. A heat exchanger according to claim 4 wherein said rear horizontal duct and said forward horizontal duct are both circular in cross-section.

6. A heat exchanger according to claim 5 wherein said left U-shaped side section and said right U-shaped side section each have a cross-sectional area of approximately sixteen square inches and wherein the diameter of said rear horizontal duct and said forward horizontal duct are both approximately four inches.

7. A heat exchanger according to claim 6 further including a forced draft means.

8. A heat exchanger according to claim 7 wherein said forced draft means includes a first fan located in the open of the lower duct of the left U-shaped side section and a second fan located in the open end of the lower duct of the right U-shaped side section.

9. A heat exchanger according to claim 1 further including a forced draft means.

10. A heat exchanger according to claim 9 wherein said forced draft means includes a first fan located in the open end of the lower duct of the left U-shaped side section and a second fan located in the open end of the lower duct of the right U-shaped side section.

* * * * *